US008955607B2

(12) United States Patent
Whitney, Jr.

(10) Patent No.: US 8,955,607 B2
(45) Date of Patent: Feb. 17, 2015

(54) COOLING ARRANGEMENTS FOR FIRE SUPPRESSION SPRINKLER SYSTEM FIRE PUMPS

(75) Inventor: John T. Whitney, Jr., Blanchester, OH (US)

(73) Assignee: Clarke Fire Prevention Products, Inc., Cincinnati, OH (US)

( * ) Notice: Subject to any disclaimer, the term of this patent is extended or adjusted under 35 U.S.C. 154(b) by 91 days.

(21) Appl. No.: 13/489,577

(22) Filed: Jun. 6, 2012

(65) Prior Publication Data

US 2012/0312563 A1 Dec. 13, 2012

Related U.S. Application Data

(60) Provisional application No. 61/495,154, filed on Jun. 9, 2011.

(51) Int. Cl.

| | |
|---|---|
| ***A62C 2/00*** | (2006.01) |
| ***F04D 15/00*** | (2006.01) |
| ***F04D 29/58*** | (2006.01) |

(52) U.S. Cl.

CPC ..... *F04D 15/0088* (2013.01); *F04D 29/5866* (2013.01); *F04D 29/588* (2013.01)

USPC ..... 169/43; 169/13; 169/16; 169/19; 239/124; 239/128; 123/41.09; 123/41.55

(58) Field of Classification Search

USPC ..... 169/13, 16, 19, 43, 54; 239/124, 127, 239/128; 123/41.09, 41.55; 417/18, 34; 62/259.4

See application file for complete search history.

(56) References Cited

U.S. PATENT DOCUMENTS

| | | | |
|---|---|---|---|
| 2,820,414 | A | 1/1958 | Fejedelem |
| 2,931,305 | A | 4/1960 | Stratton |
| 3,116,694 | A | 1/1964 | Eberhardt |
| 3,213,605 | A | 10/1965 | Welden |
| 3,235,009 | A | 2/1966 | Nelson |
| 3,459,131 | A | 8/1969 | Nenf |
| 3,592,220 | A | 7/1971 | Reinke |
| 3,613,520 | A | 10/1971 | Worden |

(Continued)

FOREIGN PATENT DOCUMENTS

| | | |
|---|---|---|
| GB | 555596 | 8/1943 |
| GB | 1376622 | 12/1974 |
| JP | 2006-20846 | 1/2006 |

OTHER PUBLICATIONS

International Search Report and Written Opinion, Mailed Aug. 24, 2012, PCT/US2012/40861; 11 pgs.

*Primary Examiner* — Steven J Ganey
(74) *Attorney, Agent, or Firm* — Thompson Hine LLP

(57) ABSTRACT

A building sprinkler system includes a pump having an input for receiving water and an output that is connected to selectively feed a plurality of sprinkler heads. A driver is operatively connected to the pump for driving the pump. A cooling arrangement is provided for cooling the pump during pump testing operations. The cooling arrangement includes: a heat exchanger with a primary loop formed by a flow path for delivering water from the output of the pump through the heat exchanger and back to the input of the pump, and a secondary loop formed by a flow path for delivering coolant from the heat exchanger through a radiator and back to the heat exchanger so that heat is transferred from the water to the coolant via the heat exchanger and from the coolant to air via the radiator.

16 Claims, 2 Drawing Sheets

(56) References Cited

U.S. PATENT DOCUMENTS

| | | | | |
|---|---|---|---|---|
| 3,797,967 | A | 3/1974 | Howeth | |
| 3,894,811 | A | 7/1975 | Bergey et al. | |
| 3,939,914 | A | 2/1976 | Carroll | |
| 3,977,603 | A | 8/1976 | Magee, Jr. | |
| 3,997,282 | A | 12/1976 | Thomas et al. | |
| 4,024,711 | A | 5/1977 | Russell, Jr. | |
| 4,033,740 | A | 7/1977 | Meckler | |
| 4,081,023 | A | 3/1978 | Edelstein et al. | |
| 4,158,529 | A | 6/1979 | Nonnemacher et al. | |
| 4,232,997 | A | 11/1980 | Grimmer et al. | |
| 4,492,525 | A | 1/1985 | Bilyeu | |
| 4,545,740 | A | 10/1985 | Nishikiori et al. | |
| 4,611,290 | A | 9/1986 | Henningsen et al. | |
| 4,653,688 | A | 3/1987 | Grinsteiner | |
| 5,035,580 | A | 7/1991 | Simonette | |
| 5,155,996 | A | 10/1992 | Tatsumi et al. | |
| 5,174,723 | A | 12/1992 | Groger et al. | |
| 5,203,680 | A | 4/1993 | Waldrop | |
| 5,286,171 | A | 2/1994 | Murota et al. | |
| 5,305,680 | A | 4/1994 | Weber | |
| 5,410,878 | A | 5/1995 | Lee et al. | |
| 5,479,778 | A | 1/1996 | Toyooka et al. | |
| 5,784,885 | A | 7/1998 | Ishihama et al. | |
| 5,848,877 | A | 12/1998 | Dill et al. | |
| 5,888,051 | A | 3/1999 | McLaughlin et al. | |
| 5,950,150 | A | 9/1999 | Lloyd et al. | |
| 6,564,627 | B1 | 5/2003 | Sabini et al. | |
| 6,634,373 | B1 | 10/2003 | Nilsen | |
| 6,651,900 | B1 * | 11/2003 | Yoshida | 169/13 |
| 7,040,868 | B2 | 5/2006 | McLaughlin et al. | |
| 7,055,546 | B2 | 6/2006 | McLaughlin et al. | |
| 7,234,922 | B2 | 6/2007 | Kunkler et al. | |
| 7,255,539 | B1 | 8/2007 | Kunkler et al. | |
| 7,581,517 | B2 * | 9/2009 | Brown | 123/41.09 |
| 7,635,253 | B2 | 12/2009 | Garcia-Ortiz | |
| 7,849,871 | B2 | 12/2010 | McLaughlin et al. | |
| 2003/0210984 | A1 | 11/2003 | Whitney | |
| 2004/0000408 | A1 | 1/2004 | Mancini et al. | |
| 2004/0219025 | A1 | 11/2004 | Garcia-Ortiz | |
| 2004/0247448 | A1 | 12/2004 | Kunkler et al. | |
| 2005/0047921 | A1 | 3/2005 | McLaughlin et al. | |
| 2005/0061373 | A1 | 3/2005 | McLaughlin et al. | |
| 2005/0244277 | A1 | 11/2005 | Hurst et al. | |
| 2005/0257559 | A1 | 11/2005 | Clark | |
| 2005/0257938 | A1 | 11/2005 | Elsey | |
| 2007/0175513 | A1 | 8/2007 | McLaughlin et al. | |
| 2008/0217443 | A1 | 9/2008 | Zacherl et al. | |
| 2008/0302317 | A1 | 12/2008 | Brown | |
| 2009/0159021 | A1 | 6/2009 | Kardos | |
| 2009/0211728 | A1 | 8/2009 | Harley et al. | |
| 2010/0095908 | A1 | 4/2010 | Deivasigamani | |

* cited by examiner

COOLING ARRANGEMENTS FOR FIRE SUPPRESSION SPRINKLER SYSTEM FIRE PUMPS

CROSS-REFERENCE

This application claims the benefit of U.S. Provisional Application Ser. No. 61/495,154, filed Jun. 9, 2011, which is incorporated herein by reference.

TECHNICAL FIELD

This application relates to sprinkler systems used for suppressing fires and more particularly to a cooling arrangement for the sprinkler system fire pump.

BACKGROUND

Building (or other facility) sprinkler systems provide pressurized liquid (e.g., water) to extinguish or control a fire. A pump (e.g., a centrifugal pump) is used to provide the water pressure. The pump may be powered by an electric motor or other type of pump driver, such as diesel engine.

During actual operation in a fire fighting mode, water passing through the pump cools the pump and prevents it from overheating. Applicable code/regulations require that fire pumps must be periodically operated in a test mode to ensure reliability. During the test mode water is not delivered to the building sprinkler system. Instead, a small amount of water is delivered through the fire pump and diverted via a valve to an alternate path.

When the fire pump is driven, by an electric motor or by a diesel engine that is cooled by an engine mounted radiator (coolant to air) and fan, in pump test mode pressure builds up at the output side of the fire pump opening the alternate path that leads to drain. A small volume of water (e.g., 1-2% of fire pump rated flow) is delivered through the fire pump and then to the drain.

In the test mod, the small volume of water flow through the fire pump is sufficient for cooling the fire pump. However, the water is wasted by being delivered to the drain.

SUMMARY

In one aspect, a building sprinkler system includes a pump having an input for receiving water and an output that is connected to selectively feed a plurality of sprinkler heads. A driver is operatively connected to the pump for driving the pump. A cooling arrangement is provided for cooling the pump during pump testing operations. The cooling arrangement includes: a heat exchanger with a primary loop formed by a flow path for delivering water from the output of the pump through the heat exchanger and back to the input of the pump, and a secondary loop formed by a flow path for delivering coolant from the heat exchanger through a radiator and back to the heat exchanger so that heat is transferred from the water to the coolant via the heat exchanger and from the coolant to air via the radiator.

In the foregoing system, flow along the primary loop may be controlled via a valve that opens in response to pressure. The valve may be configured to remain closed under pressure conditions experienced when water is being delivered from the pump to the sprinkler heads, thereby preventing diversion of flow from the sprinkler heads when water flow to the sprinkler heads is needed for firefighting. The valve may be a pressure relief valve that opens when pressure exceeds a set high threshold.

The primary loop preferably lacks any dump to drain so that water flowing along the primary loop is not wasted.

In one implementation of the system, the driver is an electric motor, the secondary loop includes an electric motor driven pump for causing coolant flow through the secondary loop, and the radiator includes an electric fan. The electric motor driven pump and the electric fan may be controlled according a temperature of water in the primary loop downstream of the valve.

In another implementation of the system, the driver is an engine, and the secondary loop includes shared flow through the engine and radiator. Flow of coolant through the secondary loop may be provided by an additional engine coolant pump, flow of coolant from the heat exchanger may be available for flow into the engine, and a thermostat may be located along the secondary loop downstream of the engine, with the heat exchanger is located upstream of the engine.

The secondary loop may include a bypass flow path provided from the downstream side of the engine to the upstream side of the engine under control of the thermostat.

The additional engine coolant pump may be located between the output of the radiator and the input of the heat exchanger, and the output of the heat exchanger may feed both a first path into the engine and a second path that bypasses the engine. The first path and the second path may overlap at least in part and a flow restrictor may be located in the second path downstream of a location where the first flow path and the second flow path diverge.

The engine, heat exchanger and radiator may be configured as a unit, with an end portion of the unit extending through a building wall to place the radiator external of the building and to place the engine and heat exchanger internal of the building, thereby placing air flow requirements for cooling of the radiator outside of the building.

In another aspect, a method is provided for testing a fire pump of a facility fire suppression system that includes the fire pump, a fire pump driver and a plurality of sprinkler heads. The method involves: operating the fire pump driver to deliver water through the fire pump while maintaining a flow path from the fire pump to the sprinkler heads in a closed condition; responsive to pressure build-up at the output side of the fire pump, opening a flow path from the output side, to and through a heat exchanger and back to the input side of the pump to circulate water without wasting water; and providing a secondary flow path for coolant fluid from the heat exchanger to a radiator and back to and through the heat exchanger for transferring heat from the water to the coolant via the heat exchanger and for transferring heat from the coolant to air via the radiator.

In the subject method, the fire pump driver may be an engine and the secondary flow path from the heat exchanger may include both a first path from the heat exchanger, through the engine and to the radiator and a second path from the heat exchanger to the engine without passing through the engine. The first path and the second path may overlap at least in part and a flow restrictor is located in the second path downstream of a location where the first flow path and the second flow path diverge.

DETAILED DESCRIPTION

Figure 1:
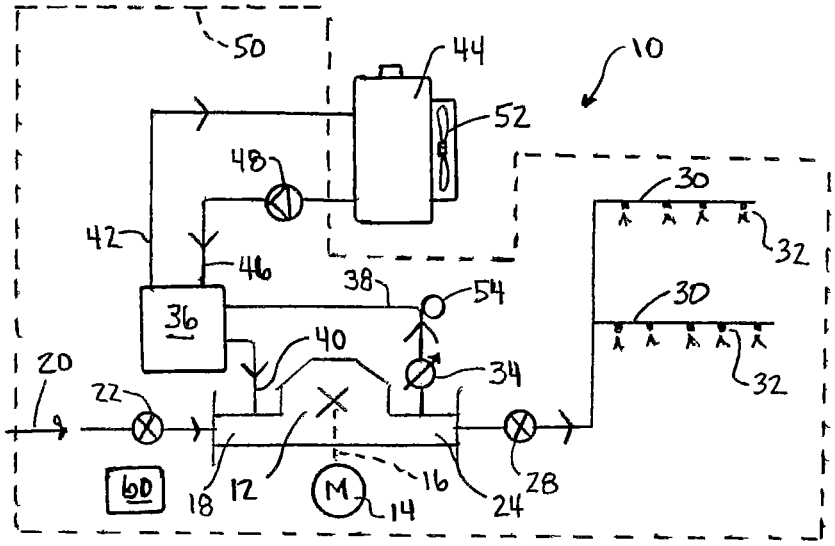
FIG. 1 is a schematic depiction of one embodiment of a fire suppression sprinkler system with fire pump cooling arrangement where the fire pump is driven by an electric motor.

Referring to FIG. 1, an exemplary sprinkler system 10 with fire pump cooling arrangement is shown. System 10 includes a fire pump 12 driven by an electric motor 14 (the connection between the two shown schematically at 16). The input side 18 of the fire pump is connected to source water 20 via a valve 22. The output side 24 of the fire pump is connected via a valve 28 to a sprinkler arrangement 26 that may be made up of numerous pipes 30 and numerous associated fire sprinkler nozzles 32, each of which typically has an associated temperature sensitive valve that opens only in the presence of a high temperatures as may be caused by a fire event. Valves 22 and 28 may be, for example, manually operated valves that are maintained in respective open positions at all times when the sprinkler system is in the stand-by mode in the event the sprinkler system needs to be operated for fire suppression. During a fire suppression/extinguishing operation, the motor 14 is operated to drive the fire pump 12 and valves 22 and 28 are open so that water flows freely through the system and out through one or more of the nozzles 32.

During test mode operation, the motor 14 is operated to drive the fire pump, but there is no flow out of any of the nozzles because the nozzles are temperature controlled and do not open except in the presence of a high temperature. This condition of no nozzle flow is called shut-off. This results in a pressure build-up (called rise to shutoff) at the output side 24 of the fire pump that is higher than the output side pressure produced during delivery of water to the sprinkler arrangement 26 when fire fighting. This high pressure causes a pressure relief valve 34 to open, delivering water through a liquid to liquid (e.g., water to freeze protected water) heat exchanger 36 via flow path 38 and then back to the input side 18 of the fire pump via flow path 40. This path makes up a primary loop of the heat exchanger. During fire extinguishing operation the fire pump output pressure is lower than during shutoff, and the pressure valve 34 remains closed.

The cooling arrangement includes a secondary loop from the heat exchanger 36 via flow path 42 to a radiator 44 and back to the heat exchanger 36 via flow path 46. Flow of freeze protected water (e.g., water with anti-freeze) in the secondary loop is provided by an electric motor driven pump 48 along flow path 46. The radiator 44 is located externally of the building or facility (shown by dashed line 50) in which the sprinkler system is installed and includes an electric fan 52 that is operated to provide air flow through the radiator to transfer heat from the coolant fluid in the secondary loop to ambient air. Electrical power to the pump 48 and fan 52 are provided from the same emergency power source that powers the fire pump motor 14 to ensure the cooling system operates properly anytime the fire motor operates.

The pump 48 and fan may be controlled by use of separate or common thermostatic sensors, preferably located downstream of the pressure relief valve 34 (e.g., per sensor 54). When the sensor 54 indicates a high temperature condition during a testing operation, the pump 48 and fan 52 are turned on to operate the secondary loop of the cooling arrangement. In an energy conservation example, the pump 48 only may be initially turned on when the sensor 54 indicates a first threshold high temperature and the fan 52 may also be turned on only if and when the sensor 54 indicates a second threshold high temperature that is higher than the first threshold high temperature. An exemplary controller 60 is shown schematically, which could be made up of control circuits, programmed processors and/or combinations of the same to control and run each of the motor 14, pump 48 and fan 52.

Figure 2:
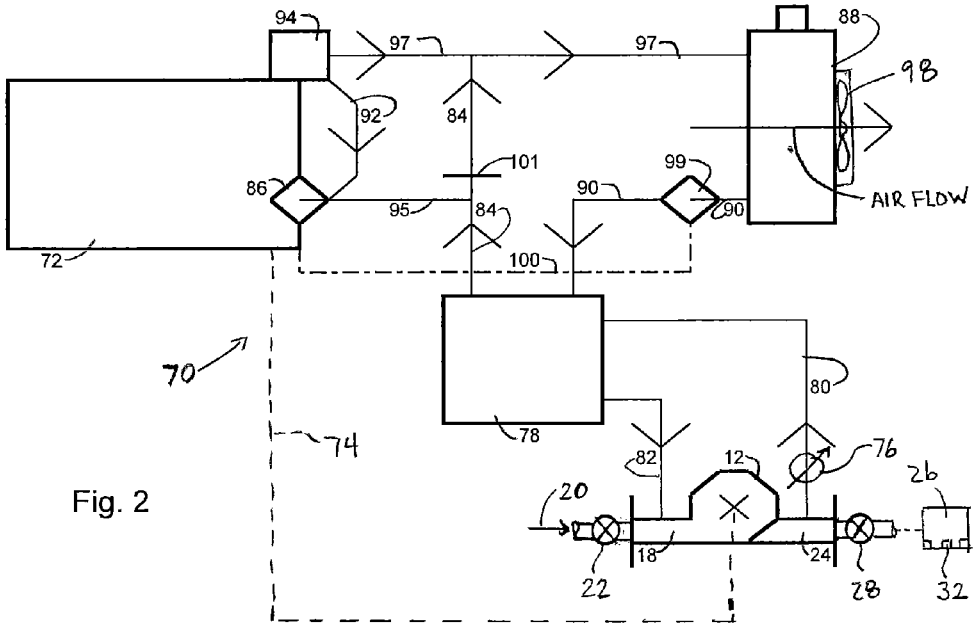
FIG. 2 is a schematic depiction of another embodiment of a fire suppression sprinkler system with fire pump cooling arrangement where the fire pump is driven by a diesel engine with radiator cooling.

Referring now to FIG. 2, another exemplary sprinkler system 70 with fire pump cooling arrangement is shown. System 70 includes a fire pump 12 driven by an diesel engine 72 (the connection between the two shown schematically by dashed line 74). The input side 18 of the fire pump is connected to source water 20 via a valve 22. The output side 24 of the fire pump is connected via a valve 28 to a sprinkler arrangement 26 that may be made up of numerous pipes (as per the embodiment of FIG. 1). During a fire fighting operation, the engine 72 is operated to drive the fire pump 12 and valves 22 and 28 are opened so that water flows freely through the system and out through one or more of the nozzles 32.

During test mode operation of the system the engine 72 is operated to drive the fire pump, but there is no flow out of any of the nozzles, which remain closed except under high temperature. This condition is called shut-off. This results in a pressure build-up (called rise to shutoff) at the output side 24 of the fire pump that is higher than the output side pressure produced during delivery of water to the sprinkler arrangement 26 when fire fighting. This high pressure causes a pressure relief valve 76 to open, delivering water through a liquid to liquid (e.g., water to coolant water) heat exchanger 78 via flow path 80 and then back to the input side 18 of the fire pump via flow path 82. This path makes up a primary loop of the heat exchanger.

The cooling arrangement includes a secondary loop from the heat exchanger 78 via flow path 84 and 95 to the input of the engine coolant pump 86. The output of the pump 86, as is typical of engines, provides pressurized flow of coolant through the engine 72 and out to the engine thermostat 94. Thermostat 94, as is typical of engines, regulates the coolant flow along either path 97 to the radiator 88 or path 92, a bypass back to the pump 86 suction, according to the temperature of the coolant in the engine 72. In the embodiment of FIG. 2, the heat exchanger 78 is inserted into the engine's cooling supply circuit, between the outlet of radiator 88 and the coolant pump 86, to form the secondary loop of the cooling system. To overcome the added pressure drop of freeze protected water (e.g., water with anti-freeze) in the secondary loop through heat exchanger 78, and provide adequate flow available to pump 86, pump 99, driven by the engine 72 (the connection between the two shown schematically by line 100), or alternatively electric motor driven, is inserted into path 90 to provide flow in the secondary loop. When the engine thermostat 94 is closed and secondary water is flowing via bypass 92 back to pump 86 suction, secondary loop flow provided by pump 99 will exit heat exchanger 78 via flow path 84 which connects with flow path 97 and flows to the radiator 88. When the engine thermostat 94 is open and secondary water is not flowing via bypass 92 back to pump 86 suction, the secondary loop flow is via path 97 back to the radiator 88. Also, during open thermostat 94 operation the suction requirement of pump 86 is provided via flow path 95 connected to flow path 84. A positive suction pressure is provided in flow path 95 by pump 99 (which has a greater flow than pump 86) at pump 86 by a restrictor 101 inserted in flow path 84 downstream of the connection with flow path 95. The temperature rise of the fire pump and engine will be more uniform during periods of warm-up operation using the illustrated configuration.

The radiator 88 may be located internally of the building or externally of the building or facility in which the sprinkler system 26 is installed and includes a fan 98 that is driven by the engine 72 so as to flow ambient air through the radiator to transfer heat from the coolant fluid in the secondary loop to ambient air.

Figure 3:
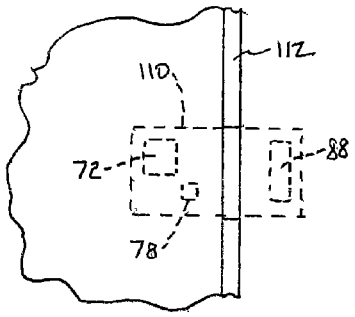
FIG. 3 is a schematic of a frame mounted unit with radiator external of a building wall and engine and heat exchanger internal of the building wall.

In one implementation, the system of FIG. 2 is constructed with a through wall engine mounted radiator. Specifically, with reference to FIG. 3, the engine 72, heat exchanger 78 and radiator are all constructed as a unit (e.g., on a common frame 110). The radiator 88 is mounted at one end of the unit frame so that the radiator can be located external of the a wall 112 of the building or facility and the engine 72 and heat exchanger 78 can be installed internal of the building or facility.

It is to be clearly understood that the above description is intended by way of illustration and example only and is not intended to be taken by way of limitation, and that changes and modifications are possible. Accordingly, other embodiments are contemplated and modifications and changes could be made without departing from the scope of this application.

What is claimed is:

1. A building sprinkler system, comprising:

a pump having an input for receiving water and an output that is connected to selectively feed a plurality of sprinkler heads;

a driver operatively connected to the pump for driving the pump; and a cooling arrangement for cooling the pump during pump testing operations, the cooling arrangement including:

a heat exchanger with a primary loop formed by a flow path for delivering water from the output of the pump through the heat exchanger and back to the input of the pump, and a secondary loop formed by a flow path for delivering coolant from the heat exchanger through a radiator and back to the heat exchanger so that heat is transferred from the water to the coolant via the heat exchanger and from the coolant to air via the radiator.

2. The system of claim 1 wherein flow along the primary loop is controlled via a valve that opens in response to pressure.

3. The system of claim 2 wherein the valve is configured to remain closed under pressure conditions experienced when water is being delivered from the pump to the sprinkler heads, thereby preventing diversion of flow from the sprinkler heads when water flow to the sprinkler heads is needed for firefighting.

4. The system of claim 2 wherein the valve is a pressure relief valve that opens when pressure exceeds a set high threshold.

5. The system of claim 2 wherein:

the driver is an electric motor;

the secondary loop includes an electric motor driven pump for causing coolant flow through the secondary loop; and the radiator includes an electric fan.

6. The system of claim 5 wherein the electric motor driven pump and the electric motor driven fan are controlled according a temperature of water in the primary loop downstream of the valve.

7. The system of claim 1 where the primary loop lacks any dump to drain so that water flowing along the primary loop is not wasted.

8. The system of claim 1 wherein:

the driver is an engine;

the secondary loop includes shared flow through the engine and radiator.

9. The system of claim 8 wherein:

flow of coolant through the secondary loop is provided by an additional engine coolant pump;

flow of coolant from the heat exchanger is available for flow into the engine;

a thermostat is located along the secondary loop downstream of the engine and the heat exchanger is located upstream of the engine.

10. The system of claim 9 wherein the secondary loop includes a bypass flow path provided from the downstream side of the engine to the upstream side of the engine under control of the thermostat.

11. The system of claim 9 wherein:

the additional engine coolant pump is located between the output of the radiator and the input of the heat exchanger;

the output of the heat exchanger feeds both a first path into the engine and a second path that bypasses the engine.

12. The system of claim 11 wherein:

the first path and the second path overlap at least in part and a flow restrictor is located in the second path downstream of a location where the first flow path and the second flow path diverge.

13. The system of claim 8 wherein the engine, heat exchanger and radiator are configured as a unit and an end portion of the unit extends through a building wall to place the radiator external of the building and the engine and heat exchanger internal of the building thereby placing air flow requirements for cooling of the radiator outside of the building.

14. A method of testing a fire pump of a facility fire suppression system that includes the fire pump, a fire pump driver and a plurality of sprinkler heads, the method comprising:

operating the fire pump driver to deliver water through the fire pump while maintaining a flow path from the fire pump to the sprinkler heads in a closed condition;

responsive to pressure build-up at the output side of the fire pump, opening a flow path from the output side, to and through a heat exchanger and back to the input side of the pump to circulate water without wasting water;

providing a secondary flow path for coolant fluid from the heat exchanger to a radiator and back to and through the heat exchanger for transferring heat from the water to the coolant via the heat exchanger and for transferring heat from the coolant to air via the radiator.

15. The method of claim 14 wherein the fire pump driver is an engine and the secondary flow path from the heat exchanger includes both a first path from the heat exchanger, through the engine and to the radiator and a second path from the heat exchanger to the engine without passing through the engine.

16. The method of claim 15 wherein the first path and the second path overlap at least in part and a flow restrictor is located in the second path downstream of a location where the first flow path and the second flow path diverge.

* * * * *